US007204120B2

(12) United States Patent
Koppensteiner

(10) Patent No.: US 7,204,120 B2
(45) Date of Patent: Apr. 17, 2007

(54) APPARATUS FOR CUTTING A WORKPIECE

(75) Inventor: Robert Koppensteiner, Steyr (AT)

(73) Assignee: GFM Beteiligungs- und Management GmbH & Co KG, Steyr (AT)

( * ) Notice: Subject to any disclaimer, the term of this patent is extended or adjusted under 35 U.S.C. 154(b) by 9 days.

(21) Appl. No.: 11/136,999

(22) Filed: May 25, 2005

(65) Prior Publication Data

US 2006/0065037 A1 Mar. 30, 2006

(30) Foreign Application Priority Data

May 26, 2004 (AT) ..... A 906/2004

(51) Int. Cl.
*B21J 13/10* (2006.01)

(52) U.S. Cl. ..... 72/420; 72/419

(58) Field of Classification Search ..... 72/420, 72/421, 425, 441, 443, 361, 419, 422
See application file for complete search history.

(56) References Cited

U.S. PATENT DOCUMENTS 3,874,218 A * 4/1975 Bachmann ..... 72/452.9
5,000,028 A * 3/1991 Krieger ..... 72/421
5,218,855 A * 6/1993 Werner et al. ..... 72/420

FOREIGN PATENT DOCUMENTS

DE 3515759 * 11/1986

* cited by examiner

*Primary Examiner*—Ed Tolan
(74) *Attorney, Agent, or Firm*—Collard & Roe, P.C.

(57) ABSTRACT

An apparatus is described for forging a workpiece (3) with an intermittently drivable clamping head (4) for the workpiece (3) and with a counter-holder (5) for receiving the end of the workpiece (3) averted from the clamping head (4), which counter-holder is rotatably held in a frame (12). In order to provide advantageous constructional conditions it is proposed that the counter-holder (5) is connected with an intermittent rotational drive (13) which can be triggered synchronously to the clamping head (4).

3 Claims, 3 Drawing Sheets

APPARATUS FOR CUTTING A WORKPIECE

CROSS REFERENCE TO RELATED APPLICATIONS

Applicant claims priority under 35 U.S.C. §119 of Austrian Application No. A906/2004 filed May 26, 2004.

FIELD OF THE INVENTION

The invention relates to an apparatus for forging a workpiece with an intermittently drivable clamping head for the workpiece and with a counter-holder for receiving the end of the workpiece averted from the clamping head, which counter-holder is rotatably held in a frame.

DESCRIPTION OF THE PRIOR ART

In order to support a workpiece during forging not only by way of a clamping head drivable through a spindle, but also to provide support at the end opposite of the clamping head, a counter-holder is used which is rotatably held in a frame coaxially to the spindle of the clamping head. The counter-holder, which may optionally be used to exert an upsetting force on the workpiece, is co-rotated by the workpiece which is fixed against rotation during the application of the forging tool. This requires an intermittent drive of the clamping head in order to avoid impermissible torsional strain on the workpiece. For this purpose it is known (AT 278 481 B) to drive the spindle with the clamping head via a worm gear pair whose worm, which is axially held in a displaceable manner in a hollow drive shaft, rests axially on a spring brake. The continuous rotational drive of the drive shaft can thus be overlapped by a rotary oscillating drive by the worm gear when the worm is axially displaced. This axial displacement, which occurs when the workpiece is fixed by the forging tools, leads to a tensioning of the spring brake which ensures an axial restoring movement of the worm once the workpiece has been released again by the forging tools. When providing a respective adaptation of the resonance behavior of the spring brake on the oscillating drive system, an intermittent drive for the spindle can be achieved which is synchronous with the drive of the forging tools. Despite these measures, there is the likelihood of an excessive torsional strain on the workpiece, especially in the case of an increasing number of impacts of the forging tools and higher requirements placed on the upsetting force to be applied between the clamping head and counter-holder on the workpiece, because in these cases one must expect respectively high frictional forces in the axial bearings of the counter-holder and high inertia forces by the intermittent rotary movement of the workpiece. Relative rotations are consequently obtained between the counter-holder and the clamping head which need to be compensated through the workpiece, leading to impairments in the forging process and the forging quality.

SUMMARY OF THE INVENTION

The invention is thus based on the object of providing an apparatus for forging a workpiece of the kind mentioned above in such a way that a favorable forging quality can be ensured even at high numbers of impact of the forging tools and high upsetting forces between the clamping head and counter-holder.

This object is achieved by the invention in such a way that the counter-holder is connected with an intermittent rotational drive which can be triggered synchronously to the clamping head.

Since as a result of this measure the rotational entrainment of the counter-holder by the workpiece can be omitted, which workpiece is driven synchronously in an intermittent manner from both ends, the rotational advancement of the workpiece can be adjusted in an advantageous manner to the drive of the forging tool, thus ensuring that a predetermined forging sequence can be maintained. An additional factor is that these drive units can be provided with a smaller configuration due to the division of the torque to two drive units, which torque is necessary for the rotational advance of the workpiece. The additional drive of the counter-holder also reduces the torsional strain on the workpiece.

In order to provide simple constructional conditions, the clamping head and the counter-holder can be provided with substantially corresponding intermittent rotational drives. In that case it is then merely necessary to ensure a synchronous drive of such rotational drives. For this purpose, the rotational drives can be joined in the known manner with superposition gears which rest on the spring brakes, so that the excitation of the superposition gears occurs depending on the drive of the forging tools by forging tools themselves which periodically fix the workpiece. It is also possible to derive the synchronization of the intermittent rotational drives for the clamping head and the counter-holder from the drive of the forging tools or from a constructional part driven by said drive. In this case it is recommended to trigger the intermittent rotational drives for the clamping head and the counter-holder via a common control device, although in principle it would also be possible to perform the synchronization of the intermittent rotational drive with the help of control pulses which are derived from the intermittent rotational drive of the clamping head.

BRIEF DESCRIPTION OF THE DRAWING

The subject matter of the invention is shown by way of example in the drawings, wherein.

DESCRIPTION OF THE PREFERRED EMBODIMENT

Figure 1:
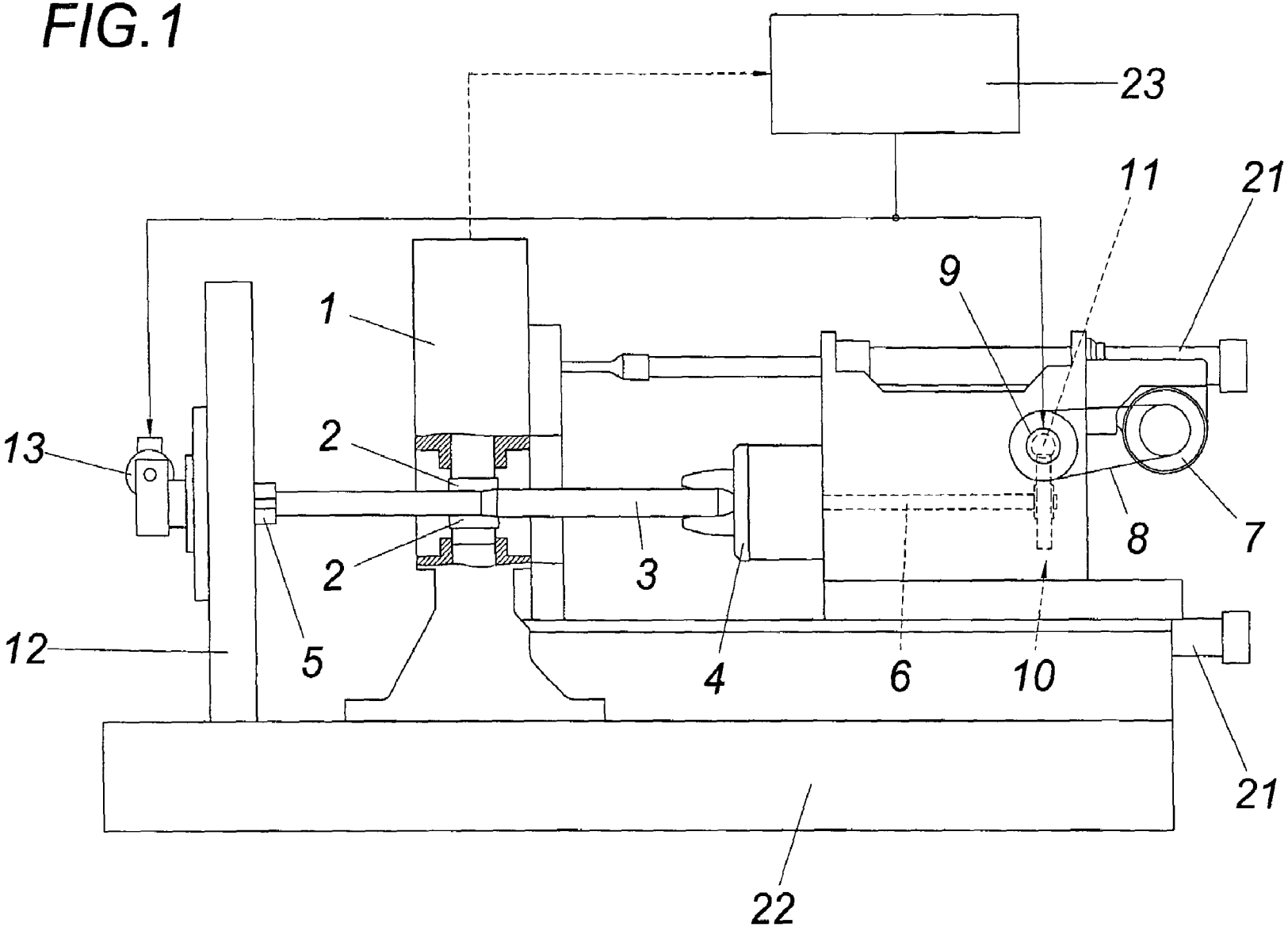
FIG. 1 shows an apparatus in accordance with the invention for forging a work piece in a simplified vertical sectional view.

According to FIG. 1, the illustrated apparatus comprises a forging unit 1 with mutually opposite paired forging tools 2 for a workpiece 3 which is clamped on the one hand in the clamping head 4 and is supported on the other hand on a counter-holder 5. The clamping head 4 is driven in a conventional manner via a spindle 6, namely with the help of a continuous rotational drive 7 which drives a drive shaft 9 for a worm gear 10 via a belt dive 8, with the worm 11 being held in an axially displaceable way relative to the drive shaft 9 and resting on a spring brake in order to ensure an intermittent drive of the spindle 6 depending on the respective engagement of the cutting tools 2.

Figure 2:
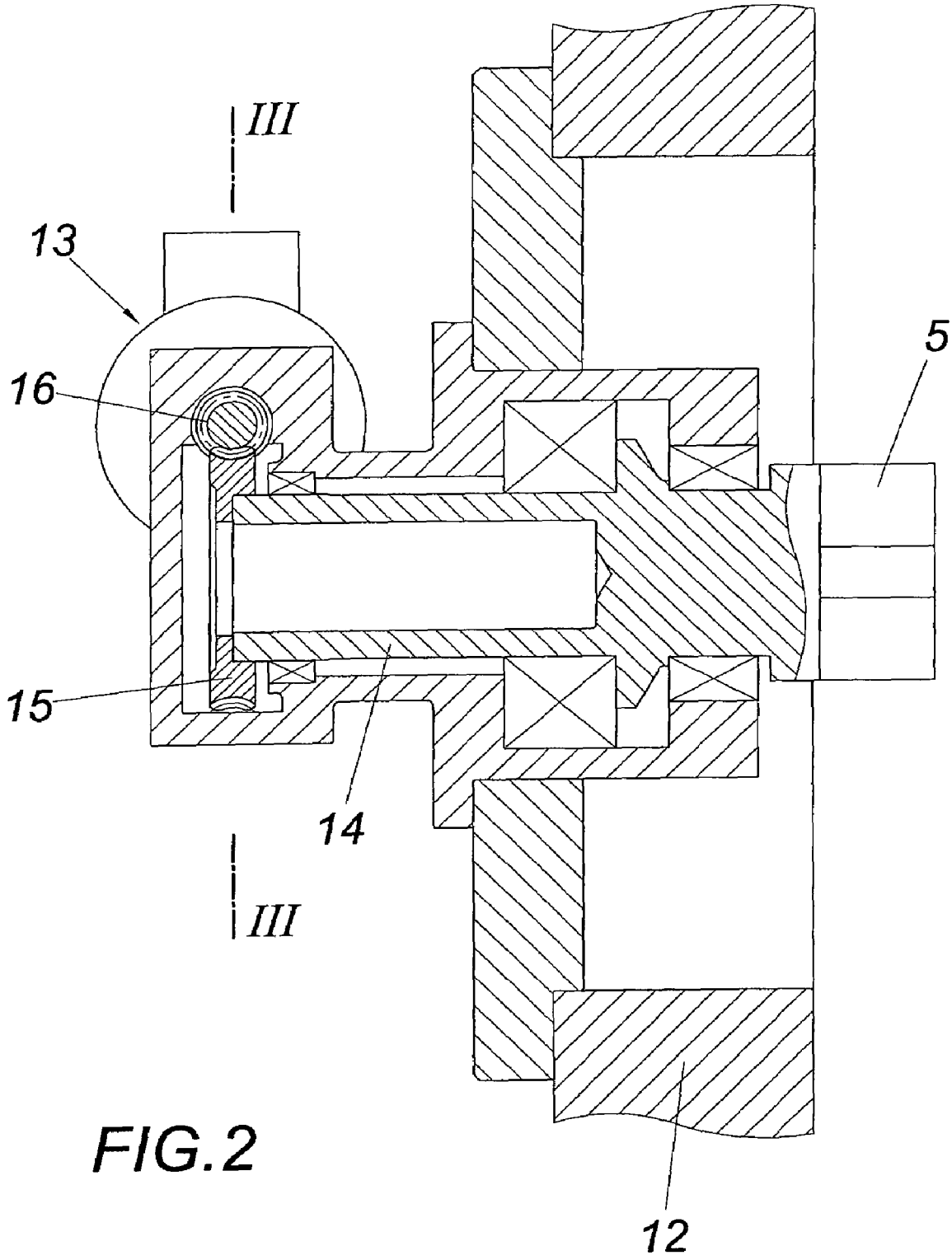
FIG. 2 shows a longitudinal sectional view through the counter-holder on an enlarged scale.
Figure 3:
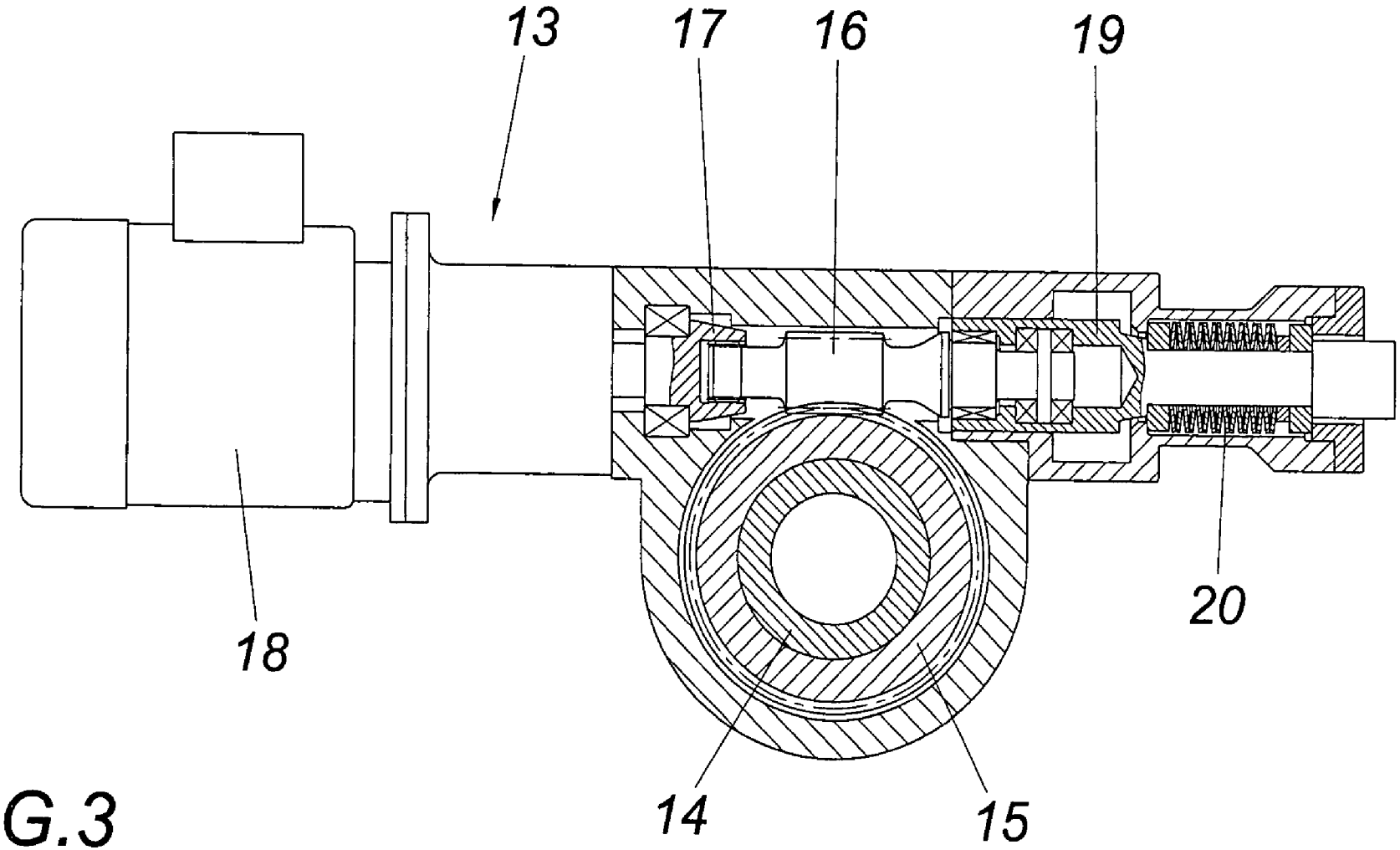
FIG. 3 shows a sectional view along line III—III of FIG. 2.

The counter-holder 5 is rotatably held in a conventional manner in a frame 12 via radial and axial bearings. In contrast to conventional constructions, an intermittent rotational drive 13 is provided for the counter-holder 5 which corresponds substantially with the intermittent rotational drive for the spindle 6 of the clamping head 4. As is shown in FIGS. 2 and 3, the shaft carrying the counter-holder 5 is driven via a worm gear 15 whose worm 16 is held in an axially displaceable way in a hollow drive shaft 17 of a continuous rotational drive 18. Since the worm 16 rests in the axial direction on a spring brake 20 via a bearing box 19 which is held in an axially displaceable way, the worm 16 is axially displaced during the braking of the workpiece 3 by the engaging forging tools 2 as a result of the continuous worm drive via the drive shaft 17, leading to a tensioning of the spring brake 20. Following the release of the workpiece 3 by the forging tools 2, the tensioned spring brake 20 causes a return of the worm 16 with the effect of a drive of the shaft 14 for the counter-holder 5, which drive is leading relative to the continuous worm rotation. The counter-holder 5 is thus driven synchronously with the clamping head 5 in an intermittent fashion in the case of a respective adjustment of the spring brake 20, with the synchronization being forced by the forging tools 2.

It is understood that the invention is not limited to the illustrated embodiment. Apart from the fact that the forging unit 1 need not be displaced along the workpiece 3 on a bed 22 via an actuating cylinders 21 and that instead the axial displacing movement for the workpiece 3 can also be achieved by an axial displacement of the clamping head 4 and the counter-holder 5, the spring brakes of the superposition gears for the intermittent rotational movement of the clamping head 4 and the counter-holder 5 can be replaced by oscillation drives which then need to be triggered synchronously for driving the forging tools 2. For this purpose, a common control device 23 can be provided, as is schematically indicated in FIG. 1. This control device 23 is triggered by the drive of the forging tools 2 and controls the oscillation drives for the intermitting rotational forward feed of the workpiece 3 depending on the movement of the forging tools 2.

The invention claimed is:

1. An apparatus for forging a workpiece, which comprises a clamping head for the workpiece, a first rotational drive for intermittently driving the clamping head, a counter-holder for receiving an end of the workpiece averted from the clamping head, the counter-holder being held rotatably in a frame, and a second rotational drive for intermittently driving the counter-holder synchronously with the clamping head.

2. The apparatus of claim 1, wherein the first and second rotational drives are at least substantially alike.

3. The apparatus of claim 1, further comprising a common control device for synchronizing the first and second rotational drives.

* * * * *